US007513832B2

(12) United States Patent
Gallagher

(10) Patent No.: US 7,513,832 B2
(45) Date of Patent: Apr. 7, 2009

(54) APPARATUS, SYSTEMS AND METHODS FOR CREATING A DYNAMIC RIDING TERRAIN

(76) Inventor: David Gallagher, P.O. Box 493, Hobart, WA (US) 98025

( * ) Notice: Subject to any disclaimer, the term of this patent is extended or adjusted under 35 U.S.C. 154(b) by 466 days.

(21) Appl. No.: 11/452,711

(22) Filed: Jun. 13, 2006

(65) Prior Publication Data

US 2007/0287547 A1 Dec. 13, 2007

(51) Int. Cl.
*A63C 19/10* (2006.01)

(52) U.S. Cl. ..... 472/89; 472/91; 14/69.5

(58) Field of Classification Search ..... 472/88–91; 405/79, 80; 482/70, 71; 14/69.5, 70
See application file for complete search history.

(56) References Cited

U.S. PATENT DOCUMENTS 219,439 A * 9/1879 Blend ..... 601/23
1,895,285 A * 1/1933 Hayhurst ..... 472/89
3,489,408 A * 1/1970 Goodrich ..... 472/89
3,536,324 A * 10/1970 Ahrens ..... 472/137
4,423,864 A * 1/1984 Wiik ..... 472/91
5,387,159 A * 2/1995 Hilgert et al. ..... 472/128

* cited by examiner

*Primary Examiner*—Kien Nguyen
(74) *Attorney, Agent, or Firm*—Graybeal Jackson LLP

(57) ABSTRACT

Apparatus, systems and methods for creating a dynamic riding terrain for wheeled sports, having a translating cylinder assembly and a flexible riding surface. The assembly includes a cylinder supporting frame, a cylinder having an axis, which is rotationally supported by the cylinder supporting frame, and opposing transition frames extending from the cylinder supporting frame, generally in a direction orthogonal to the cylinder axis. The transition frames have a proximal end adjacent to the cylinder, a distal end adjacent to a support surface when the assembly is placed thereon, and a gliding surface affixed to an upper portion thereof. A dynamic riding terrain is created when the assembly is used in conjunction with a flexible riding surface placed over the assembly and moved, either by a self-contained motor or external forces. The transition frame can be modified to alter the gliding surface profile or the location of the proximal end.

20 Claims, 6 Drawing Sheets

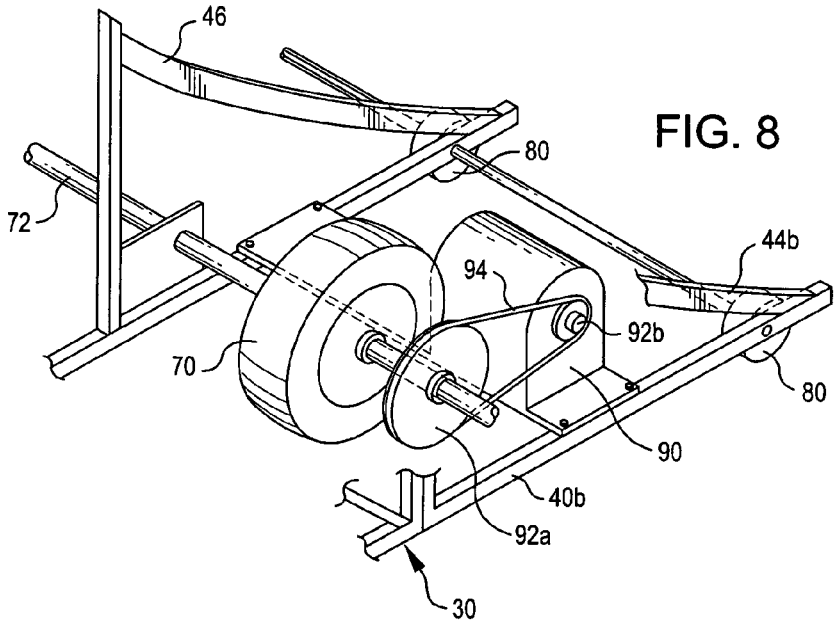
FIG. 8
FIG. 9
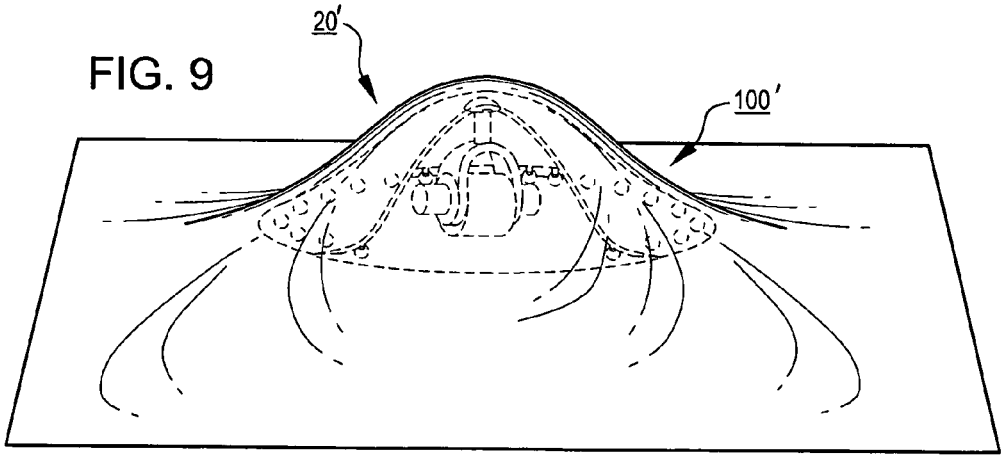

APPARATUS, SYSTEMS AND METHODS FOR CREATING A DYNAMIC RIDING TERRAIN

BACKGROUND OF THE INVENTION

Description of the Prior Art

Wheeled sports, such as skateboarding, in-line skating, BMX biking and the like have enjoyed renewed popularity due to "extreme" competitions such as the presently broadcast "X-Games" and similar genre programming. In these competitions, riders perform maneuvers in the confines of a terrain park. Terrain parks traditionally have ramps, pipes, jumps, hills, bowls and other geometric features that challenge the rider's skills and permit the riders to perform a variety of acrobatics, often many feet above the ground.

An inherent aspect of terrain parks is their static nature. Once a rider becomes familiar with the terrain, the rider can then focus on exploiting that knowledge to allow him or her to incorporate tricks that would otherwise be inadvisable if the terrain was not known. While such an environment facilitates a rider's ability to master his or her skills, or provide thrills to a crowd or the rider, it does little to test the rider's skills in adapting to a changing environment, or provide new opportunities to perform in the park.

SUMMARY OF THE INVENTION

The invention is directed to providing a means for creating a dynamic terrain for wheeled sports, the resulting terrain (system), as well as related methods. A first aspect of the invention relates to the means for creating a dynamic terrain for wheeled sports in conjunction with a support surface. The means is characterized as a translating cylinder assembly comprising a cylinder supporting frame which rotationally supports a cylinder or drum. While in many embodiments of the invention the cylinder remains at a constant height above the support surface, select embodiments provide for elevation adjusting means to vary the height above the support surface either periodically or continuously, depending upon the intended effect. The elevation adjusting means comprises common adjustment apparatus such as screw jacks, lever arms, scissor arms, hydraulic or pneumatic cylinder(s) and ram(s), and direct manual manipulation whether by manual means or external assistance.

A feature of the invention permits a plurality of cylinders (and supporting frames and related structure) to be linked to each other. In this manner, the riding surface can be greater than the width of any single cylinder. Moreover, if the cylinder supporting frames but not the cylinders are linked, it is possible to establish each cylinder in the plurality at respectively different heights.

Extending from at least one side of the cylinder supporting frame is a transition frame, and preferably a pair of transition frames extends from respective sides of the supporting frame in directions substantially orthogonal to the cylinder shaft. Each transition frame comprises supporting ribs that function to transition a riding surface (discussed in greater detail below) from the horizontal, at a distal end thereof, to an inclined state relative to the horizontal, at a proximal end thereof. The supporting ribs may be rectilinear or curvilinear at the riding surface contact portions, with the later preferably having a concave cross sectional profile to approximate the curvature of a quarter-pipe when used in conjunction with the cylinder. Moreover, the supporting ribs may comprise both rectilinear and curvilinear portions, or may comprise compound curves such as by integrating concave and convex portion, with a concave portion preferably being located proximate to the cylinder. In addition, the supporting ribs may be rigid or may allow for controlled flexion. In embodiments wherein controlled flexion is permitted, the control may be passive or active. In active embodiments of the invention, additional support struts may be linked between the supporting ribs and the remaining portions of the transition frame. In this manner, the concavity of the supporting ribs can be altered. Passive flexion is provided in lieu of, or in addition to, active flexion where rebound or impact absorption is desired. In addition to the foregoing, the elevation of the proximal end of the supporting ribs may be changed, thereby affecting the nature of the horizontal to inclined transition and the point of interface between the proximal end and the cylinder or drum.

The supporting ribs may be designed to directly support the riding surface, in which case a low friction interface (gliding surface) between the supporting ribs and the riding surface is desirable. This can be accomplished through the use of a low coefficient of friction materials such as high density polytetrafluoroethylene ("PTFE") or polyethylene ("PE"), or by use of roller bearings, wheeled bearings, air bearings, or similar structure. Alternatively, and if additional support is needed for the riding surface between the supporting ribs, one or more longitudinally oriented gliding surfaces can be attached to the supporting ribs; if the supporting ribs are dynamic, segmenting the gliding surfaces is considered desirable to permit differential movement, unless a suitably compliant material is selected as the gliding surface and is able to communicate the geometric changes imparted by the changes in geometry of the supporting ribs. In many preferred embodiments, optional shovels extend from the distal ends of the supporting frame to further smooth the transition and permit easy replacement of this high wear part.

The invention is intended to be dynamic relative to the riding surface, and while it is within the scope of the invention to have the translating cylinder assembly and the support surface linked, and movable relative to the riding surface, preferred embodiments of the invention benefit from a static support surface wherein the translating cylinder assembly is movable thereon. In this vein, while a skid arrangement is within the scope of the invention, preferably a plurality of wheels or air bearings are used between the cylinder supporting frame and/or the transition frame and the support surface. To provide motility to the frames, either the cylinder or drum, or at least one of the plurality of wheels are driven by a motor. The motor preferably can be operated in variable speeds and is reversible; therefore, electric, petrochemical, pneumatic or hydraulic motors are particularly adapted for this task, and are preferably remotely controllable. Alternatively, motility may be provided externally such as by a cable system integrated into the support surface whereby an attachment linkage connects the assembly to the cable. The transition frame further supports a pair of opposed gliding surfaces that function as transitions between the cylinder or drum, and the supporting surface, and thereby reduce the coefficient of friction between the riding surface and the assembly.

As described earlier, the translating cylinder assembly is intended to be used in conjunction with a flexible riding surface. The flexible riding surface is created to substantially contact all uppermost surfaces of the translating cylinder assembly. As such, it must be able to articulate in an axis congruent to the direction of the translating cylinder assembly's movement on a supporting surface, which is also orthogonal to the axis of the cylinder shaft. In this manner, the riding surface is able to adapt to the curvature of the cylinder or drum, as well as the curvature, if any, of the supporting ribs.

In many embodiments, the riding surface comprises a plurality of elongate members having first and second major surfaces, a major axis, a minor axis and a sectional thickness. In addition, each elongate member (hereinafter referred to as a "board" for ease of reference, but not to imply that a board is the only mode of implementation) has a first elongate side and a second elongate side. The boards are preferably arranged such that the first elongate side of a first board is closely proximate to the second elongate side of a second board, and so on. The major axes of the boards are substantially congruent to the cylinder shaft axis.

All boards of the riding surface are preferably fixedly attached, such as by adhesives or mechanical fasteners, to a flexible underlayment, such as a heavy nylon fabric having a low friction coating thereon. In this manner, the relative positions of the boards are maintained, but are allowed to articulate in at least the direction of the minor axes of the boards. While close proximity between elongate sides is desirable, the boards must be able to articulate in the minor axis direction. Thus, provisions may be made to shape the intersections between the major surfaces of the boards and the elongate sides to prevent binding between adjacent boards during flexion of the riding surface. Alternatively or in addition to such shaping, a modified tongue and groove arrangement between adjacent boards may be used, thereby providing mechanical linkage between adjacent boards in addition to that provided by the flexible underlayment.

BRIEF DESCRIPTION OF THE DRAWINGS

FIG. 8 is a partial fragmentary perspective view of one means for providing motility to the translating cylinder assembly; and FIG. 9 is a perspective schematic view of an alternative system embodiment of the invention wherein an omni directional moving feature is disposed between a support surface and an omni directionally flexible riding surface.

DESCRIPTION OF THE EMBODIMENTS

Figure 1:
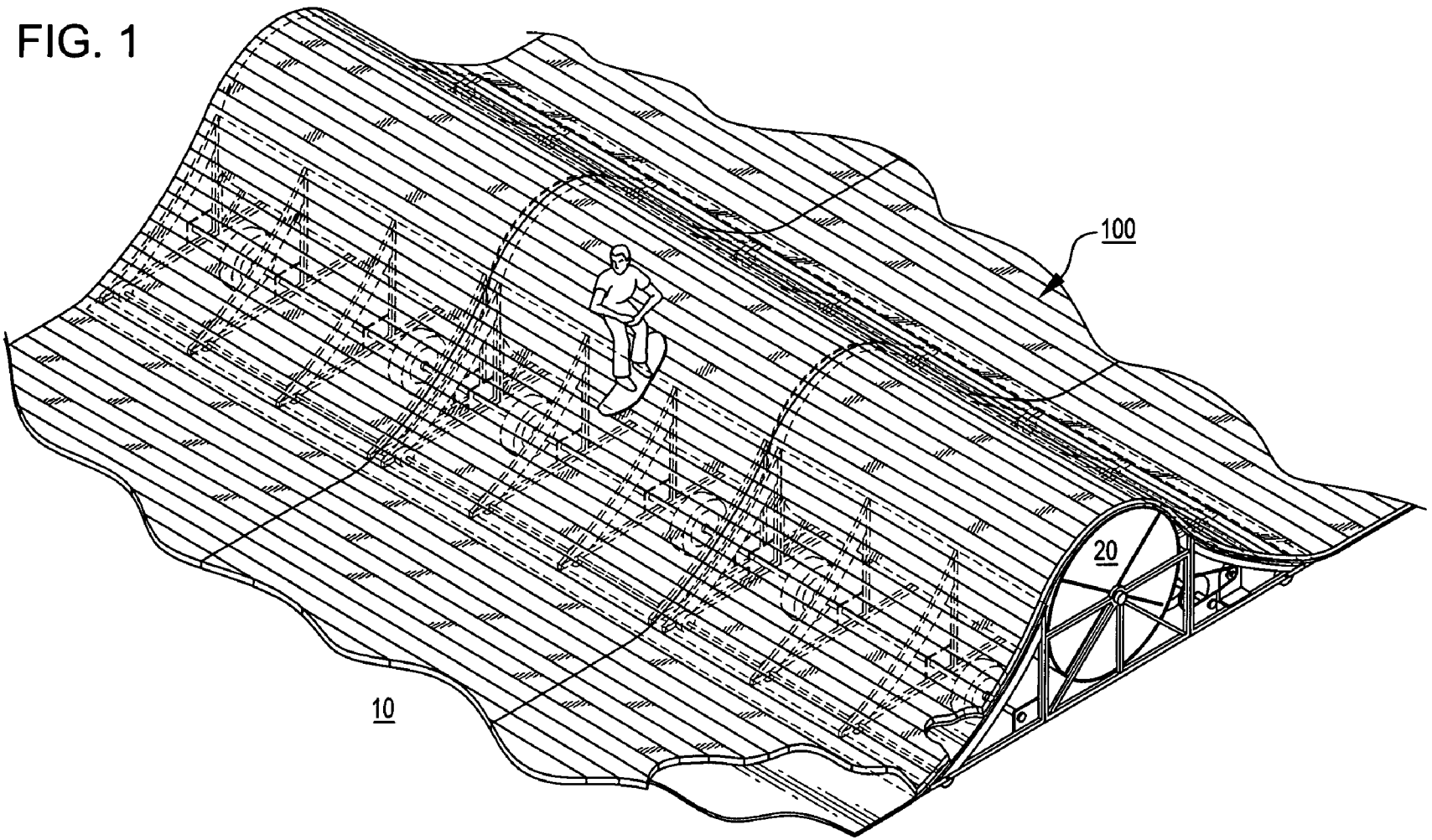
FIG. 1 is a perspective view of the system of the invention showing a plurality of linked translating cylinder assemblies supporting a flexible riding surface.
Figure 2:
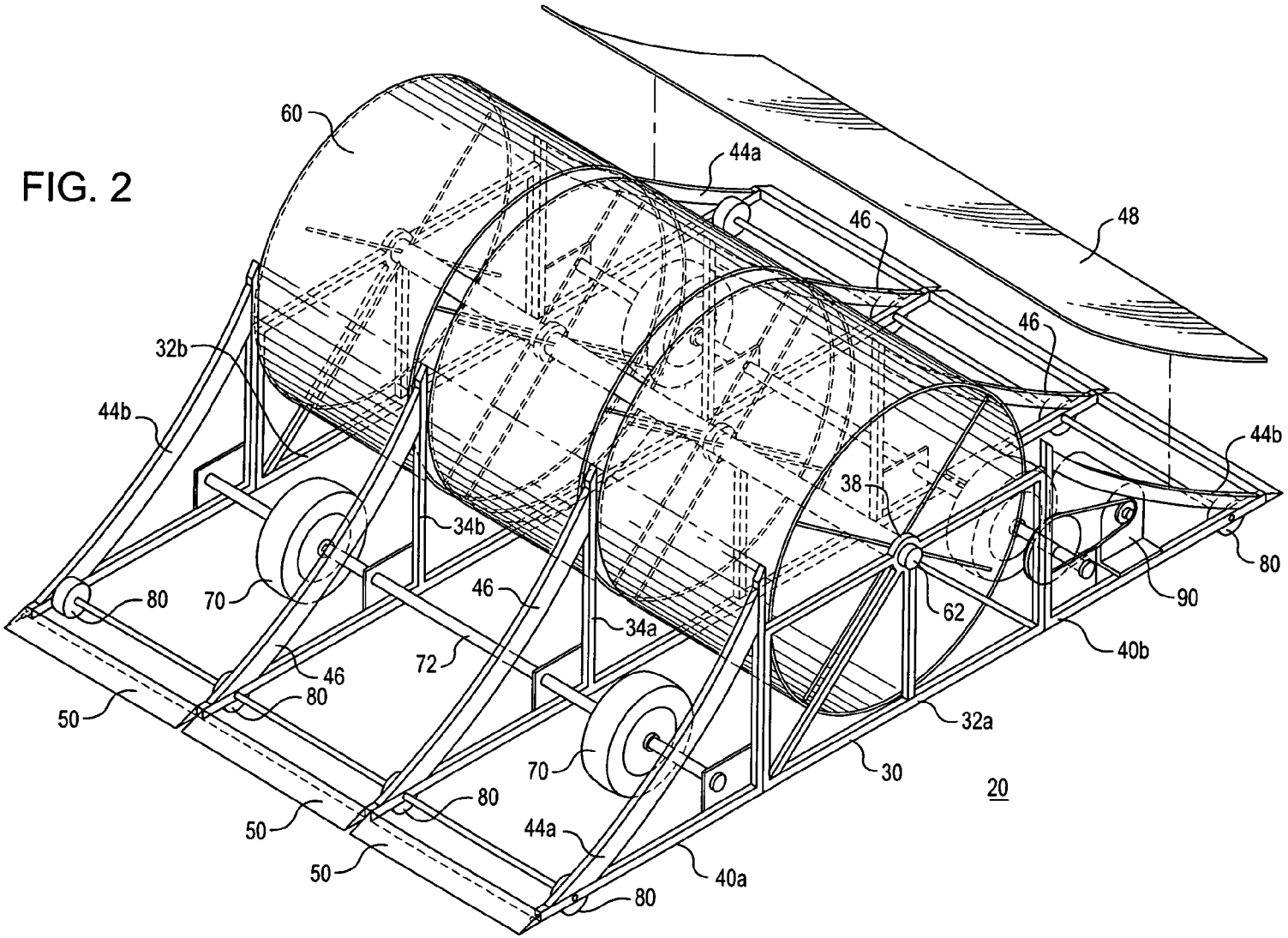
FIG. 2 is a detailed perspective view of a single translating cylinder assembly shown in partial phantom and with an optional gliding surface.
Figure 3:
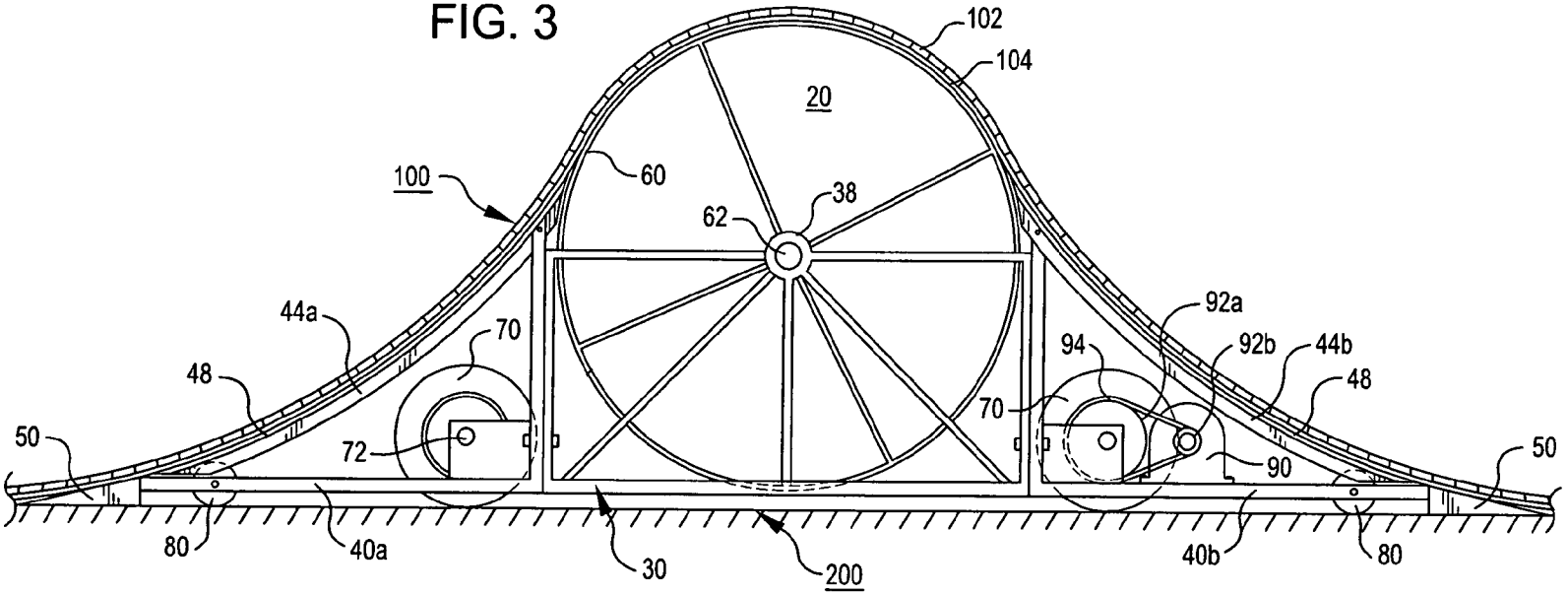
FIG. 3 is an end elevation view of the system of FIG. 1.

The following discussion is presented to enable a person skilled in the art to make and use the invention. Various modifications to the preferred embodiment will be readily apparent to those skilled in the art, and the generic principles herein may be applied to other embodiments and applications without departing from the spirit and scope of the present invention as defined by the appended claims. Thus, the present invention is not intended to be limited to the embodiment show, but is to be accorded the widest scope consistent with the principles and features disclosed herein.

Turning then to the several figures wherein like numerals represent like parts and, more particularly, to FIGS. 1-4, 7 and 8, a dynamic terrain system embodiment of the invention is shown. Dynamic terrain system 10 comprises translating cylinder assembly 20 and riding surface 100. Translating cylinder assembly 20 includes cylinder supporting frame 30, transition frames 40*a* and 40*b*, wedges 50, cylinder 60, primary support wheels 70, secondary support wheels 80, and motor drive 90.

Turning first to cylinder supporting frame 30, this structure is used to support cylinder 60 via axle 62, which is preferably hollow to reduce weight, and sized to receive a fork element from a fork lift to facilitate assembly and disassembly of assembly 20. Cylinder supporting frame 30 includes a pair of outer frame members 32*a* and 32*b*, and a pair of longitudinal inner frame members 34*a* and 34*b*. Each frame member is constructed preferably from a rigid metal such as aluminum or steel where outer frame members 32*a* and 32*b* are sized to rotationally support cylinder 60 without undue flexing. Outer frame members 32*a* and 32*b* further include axle bearings 38 for receiving cylinder axle 62. As will be appreciated by those persons skilled in the art, each cylinder support frame may be constructed in any manner sufficient to support the anticipated static and dynamic load conditions to be encountered during operation of the same.

Because the embodiment of the invention described herein can be adapted for providing a variety of ramp widths, a plurality of translating cylinder assemblies 20 may be axially connected as is best shown in FIG. 1. In such embodiments, outer frame member 32*b* of one translating cylinder assembly 20 may be mechanically linked to outer frame member 32*a* of an adjacent translating cylinder assembly 20 and so on until the desired width is achieved. Depending upon conditions, it may also be desirable to mate a cylinder axle 62 of one translating cylinder assembly 20 to an adjacent supporting frame cylinder axle 62. In such embodiments, axle 62 preferably extends beyond axle bearing 38 and is splined or otherwise keyed to accept a collar or similar connector to facilitate the linkage.

As noted above, translating cylinder assembly 20 comprises transition frames 40*a* and 40*b*. Transition frames 40*a* and 40*b* are intended to provide a suitable transition between support surface 200 and cylinder 60 when receiving riding surface 100. Each transition frame 40 comprises a pair of outer ribs 44*a* and 44*b* and a plurality of inner ribs 46. Each of these ribs preferably has a concave form to operate as a transition from the horizontal direction relative to support surface 200 at a distal end thereof to a roughly tangential position proximate to cylinder 60 at a proximal end thereof. In the illustrated embodiment, low friction gliding surface 48 is fixedly attached to ribs 44 and 46, and may be constructed from any suitable low friction material, such as polyethylene, rigid or semi rigid materials coated with a low friction surface, or similar equivalents. Attachment is preferably by means of countersunk flat head bolts, thereby ensuring sufficient attachment without protrusion of the bolt heads or formation of exposed recesses in surface 48.

At distal ends of transition frames 40*a* and 40*b* are wedges 50, which provide a moderate transition between support surface 200, and ribs 44 and 46, as substantially shown. At least the upper surfaces of wedges 50 are similarly constructed from a low friction material or other material having an exposed low friction coating. Unlike cylinder supporting frame 30, or transition frames 40*a* and 40*b*, wedges 50 are bolted or otherwise fixedly attached to transition frames 40*a* and 40*b* and are intended to glide on or move slightly above support surface 200 without benefit of an intermediate wheel or other rolling member. In order to provide sufficient support to the distal ends of transition frames 40*a* and 40*b*, caster wheels 80 may be used in a manner such as illustrated and otherwise known to those persons skilled in the art.

Because translating cylinder assembly 20 is intended to roll upon support surface 200, motive means in the form of motor 90, sprockets 92*a* and 92*b*, and belt or chain 94 are provided in conjunction with primary support wheels 70, as is best shown in FIG. 8. Primary support wheels 70 are rotationally linked to translating cylinder assembly 20 via axles 72. In the illustrated embodiment, at least one axle 72 or wheel 70 is operatively linked via sprocket 92*a* to chain or belt 94. In this manner, rotation of sprocket 92*b* of motor 90 is translated to rotation of sprocket 92*a*, which in turn directly drives a wheel 70, or if axle 72 is rigidly linked to one or a plurality of wheels 70 and is rigidly linked to sprocket 92*a*, then the one or plurality of wheels 70. In the same manner that cylinders 60 may be axially linked to one another, so may the additional support wheels via a coupler linked to a pair of axles (not shown). To provide appropriate additional support for transition frames 40*a* and 40*b*, secondary support wheels 80 are provided toward the distal ends of transition frames 40*a* and 40*b* as shown and previously described.

Motor 90 is preferably an electric motor, powered either by an onboard battery bank (not shown) or by a petrochemical combustion engine driving a generator. Alternatively, a power distribution infrastructure may be incorporated into support surface 200, such as electrified rails, cable systems or conveyor systems.

As will be appreciated by those persons skilled in the art, alternative motive means are available, and include without limitation hydraulic motors and pneumatic motors, along with appropriate systems for providing pressurized fluid and control there over. Any of these identified motors are adaptable for controlled movement, such as speed and direction, by appropriate controls. Moreover, suitable programmable logic can be incorporated to provided dampened motion so that any riders experiencing the benefits of the invention will not be subject to excessive accelerations or decelerations. In addition, the infrastructure available for motor 90 can be used to control other aspects of the assembly, such as cylinder elevation or transition modulation.

Figure 4:
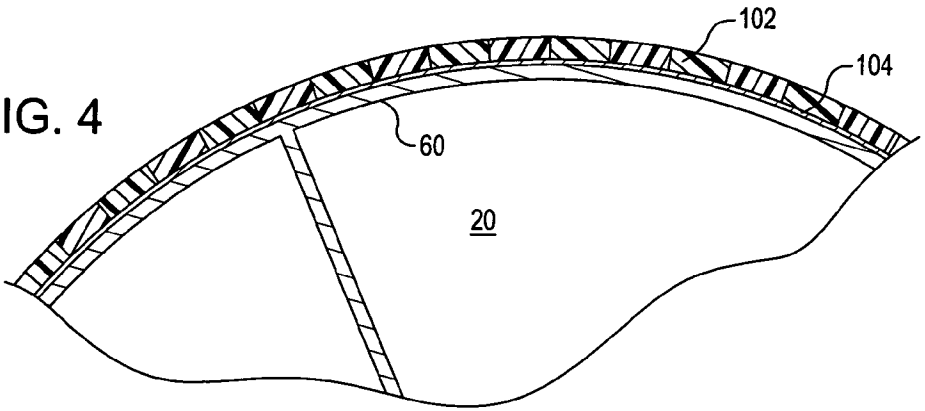
FIG. 4 is a detailed cross section elevation view of the cylinder and riding surface.
Figure 5:
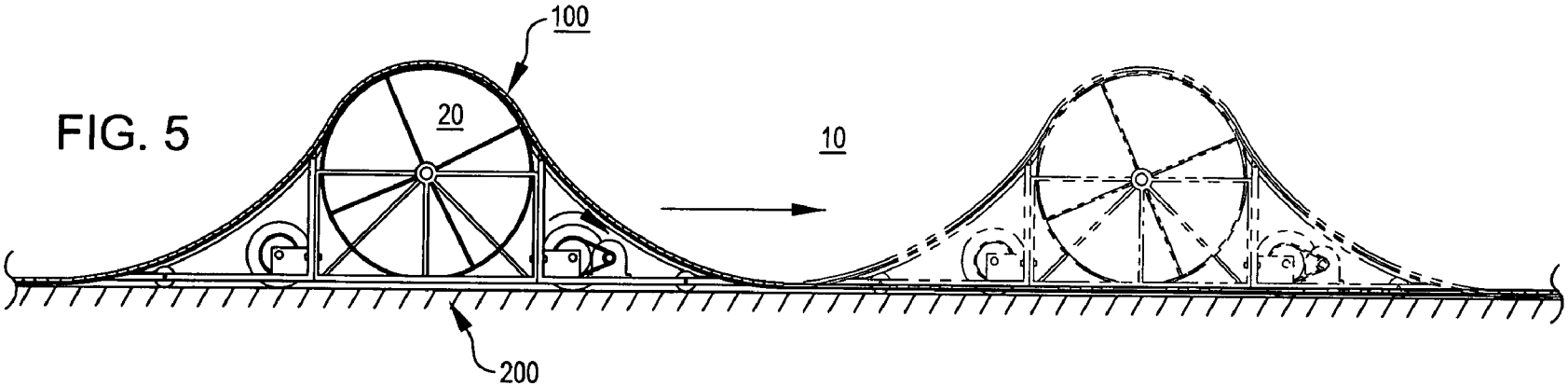
FIG. 5 illustrates in an elevation view the movement of the system of FIG. 1.
Figure 6:
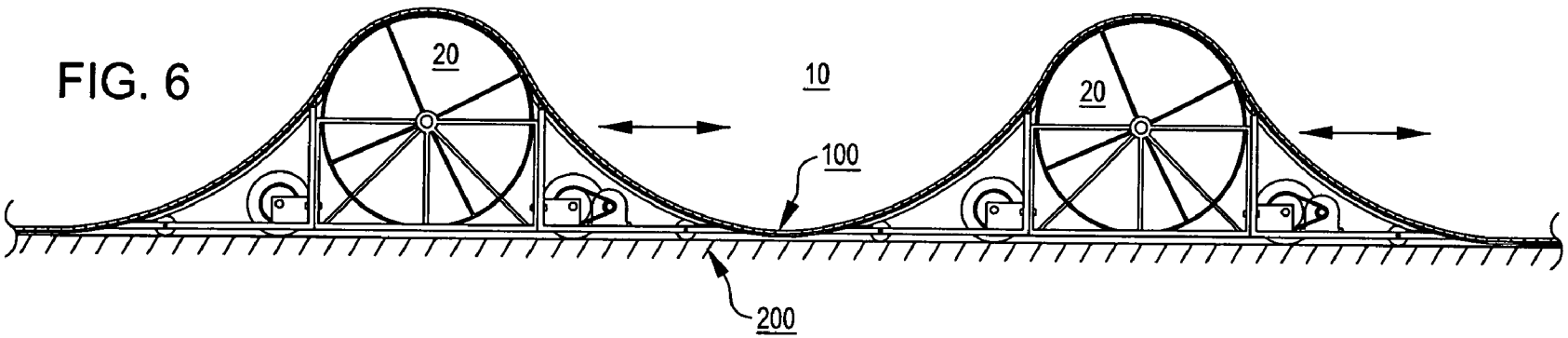
FIG. 6 illustrates in elevation view the movement of a pair of systems as shown in FIG. 1 wherein a variable half-pipe can be created or a series of variably spaced features can be navigated.
Figure 7:
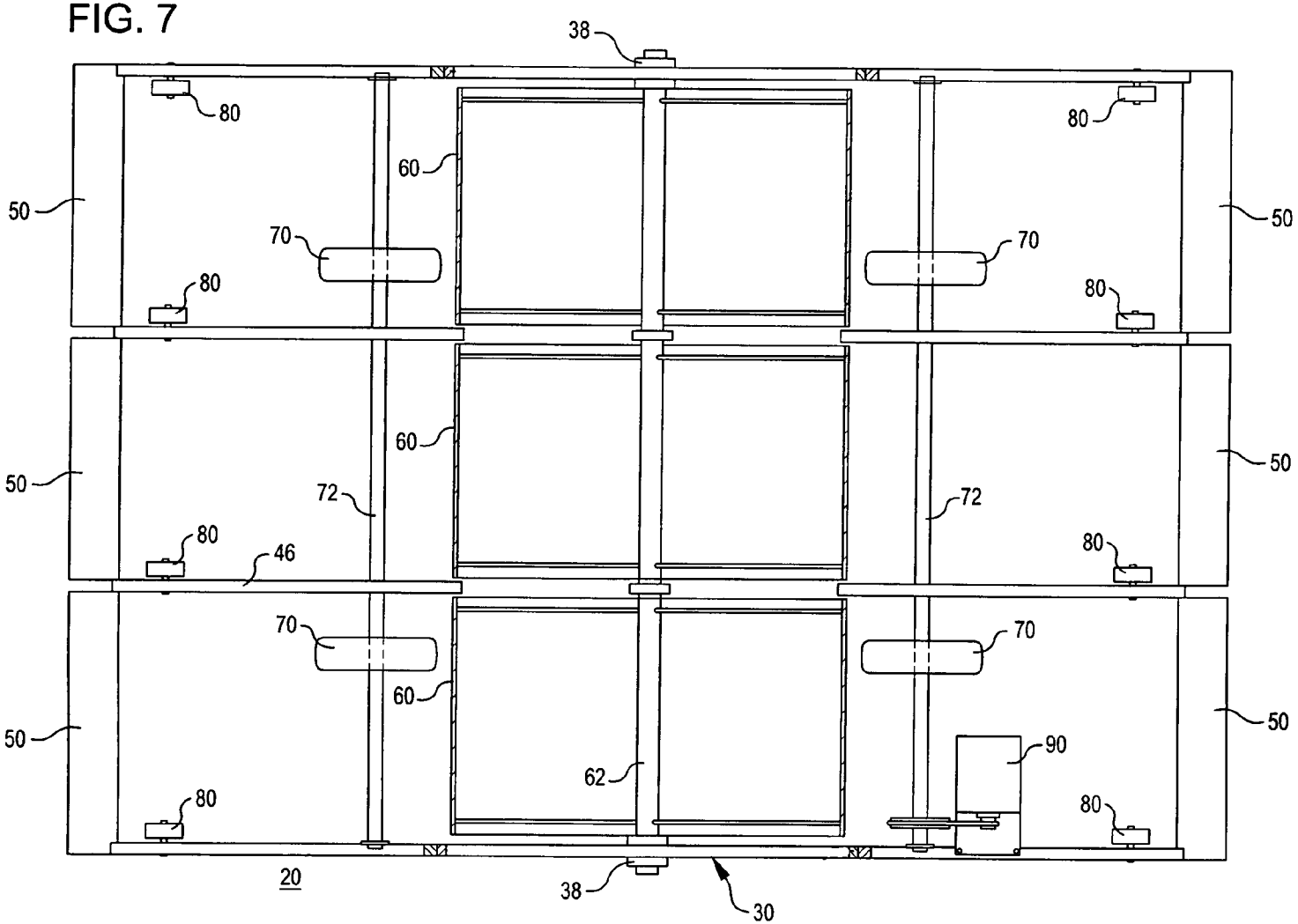
FIG. 7 is a somewhat schematic plan view in partial cross section of the translating cylinder assembly.

Turning then, in particular, to FIGS. 1 and 4, a perspective view and detailed cross section of riding surface 100 is shown. Riding surface 100 comprises a plurality of laterally extended boards 102, which are linked to each other by flexible backing 104, much as a fabric backing is linked to a plurality of slats in a rolltop desk. Boards 102 are preferably constructed from Skatelite, a high hardness and durable product manufactured by Skatelite World Headquarters of Tacoma, Wash. Because flexible backing 104, which is preferably constructed from a polymer fabric coated on at least one side with a low friction material such as high density polyethylene or PTFE, retains the close proximity of boards 102 to each other, regardless of overall flexing of riding surface 100, very few gaps are encountered. Moreover, adjacent boards 102 may have an interlocking tongue-and-groove profile where the tongue resembles an extruded ball and the groove an extruded socket, which provides additional flexible mechanical linkage in the form of pivoting motion between adjacent boards and reduces stress on the flexible backing 104. Alternatively, lateral keepers may be used to link adjacent edges to each other.

As an alternative material, the invention contemplates the use of a non-linked resilient material such as Borco or Vyco, manufactured by VyTech Industries, Inc. of Anderson, S.C. This material has both resiliency and durability. Thus, when supported by a suitable substrate, it provides a durable and desirable riding surface. A benefit associated with the use of these types of material is their ability to stretch omni directionally. This property allows it to be used in lieu of riding surface 100, or in applications such as illustrated in FIG. 9. As shown, a second feature embodiment (which is described below) creates the desired terrain profile, and omni directional riding surface 100' provides for suitable transitions between support surface 200 and omni-ramp 20'. Movement of omni-ramp 20' may be accomplished by a rotationally coupled single drive wheel 70', which is operatively linked to motor 90'. Alternatively, and like certain drive means with respect to translating cylinder assembly 20, the drive means can be integrated with support surface 200 such that omni-ramp 20' is caused to move by external means, such as cable, conveyor, rail, electrification (e.g., amusement park bumper cars), etc.

OPERATION OF A PREFERRED EMBODIMENT

Operation of the illustrated embodiment is enabled when riding surface 100 is laid over translating cylinder assembly 20, as is best shown in FIG. 1. Controlled operation of motor 90, such as by radio control, enables both speed and direction control of translating cylinder assembly 20. As motor 90 drives at least one primary support wheel 70, the reactive forces generated at such wheel against support surface 200 cause corresponding movement of translating cylinder assembly 20. As those persons skilled in the art will appreciate, it is also possible to directly drive cylinder 60 as previously described, thereby imparting rotation thereof, which transfers driving force to riding surface 100, although the illustrated method of operation is considered preferred. As translating cylinder assembly 20 translates in one direction or another, wedge 50 causes a slight elevation of riding surface 100 such that it transitions to low friction guide surface 48 and, thereafter, to the outer surface of cylinder 60. Once a segment of riding surface 100 reaches the top of cylinder 60, the functioning of the various components reverses, i.e., low friction gliding surface 48 transitions the segments to wedge 50 and, thereafter, to support surface 200.

What is claimed:

1. A translating cylinder assembly for use in creating a dynamic terrain for wheeled sports on a support surface comprising:

a cylinder supporting frame;

a cylinder having an axis, which is rotationally supported by the cylinder supporting frame;

a transition frame extending from the cylinder supporting frame, generally in a direction orthogonal to the cylinder axis, having a proximal end adjacent to the cylinder, a distal end adjacent to the support surface when the assembly is placed thereon, and gliding surface means affixed to the transition frame for reducing the coefficient of friction between the transition frame and a riding surface.

2. The translating cylinder assembly of claim 1 wherein the gliding surface means has a curved geometry.

3. The translating cylinder assembly of claim 1 wherein the transition frame comprises a plurality of ribs extending substantially from the proximal end to the distal end, and wherein the ribs are substantially rigid and fixed.

4. The translating cylinder assembly of claim 1 wherein the transition frame comprises a plurality of ribs extending substantially from the proximal end to the distal end, and wherein the ribs are dynamic in the vertical direction.

5. The translating cylinder assembly of claim 4 wherein at least some of the ribs are repositionable to modify the geometry of the gliding surface means.

6. The translating cylinder assembly of claim 1 further comprising a plurality of frame movement means for reducing the coefficient of friction between the assembly and the support surface.

7. The translating assembly of claim 6 wherein the frame movement means comprises a plurality of wheels extending from one of the cylinder supporting frame, the transition frame or both the cylinder supporting frame and the transition frame for contacting the support surface.

8. The translating assembly of claim 1 further comprising motive means for imparting movement of the assembly relative to the support surface.

9. The translating assembly of claim 8 wherein the assembly further comprises self-contained motive means.

10. The translating assembly of claim 1 further comprising a wedge positioned on the distal end of the transition frame.

11. The translating assembly of claim 1 further comprising a riding surface having a plurality of substantially planar members wherein each member, excepting perimeter planar members of the riding surface, is flexibly linked to at least two other planar members to create a flexible surface in at least one degree of rotation, and the riding surface has an exposed side and an under side.

12. The translating assembly of claim 11 wherein the flexible linkage between planar members comprises a flexible material secured to the under side of the riding surface.

13. The translating assembly of claim 11 wherein the flexible linkage between planar members comprises a plurality of flexible linkages extending from one planar member and terminating at an adjacent planar member.

14. The translating assembly of claim 11 wherein each planar member excepting perimeter planar members of the riding surface, has a tongue portion on one edge thereof and a groove portion on an opposing edge thereof.

15. A translating cylinder assembly for use in creating a dynamic terrain for wheeled sports on a support surface comprising:

a cylinder supporting frame;

a cylinder having an axis, which is rotationally supported by the cylinder supporting frame;

a first transition frame extending from the cylinder supporting frame, generally in a direction orthogonal to the cylinder axis, having a proximal end adjacent to the cylinder, a distal end adjacent to the support surface when the assembly is placed thereon, and first gliding surface means affixed to the first transition frame for reducing the coefficient of friction between the first transition frame and a riding surface; and a second transition frame extending from the cylinder supporting frame, generally in a direction orthogonal to the cylinder axis and in a direction opposite from that of the first transition frame, having a proximal end adjacent to the cylinder, a distal end adjacent to the support surface when the assembly is placed thereon, and second gliding surface means affixed to the second transition frame for reducing the coefficient of friction between the second transition frame and the riding surface wherein the first and the second gliding surface means have a concave geometric profile.

16. The translating assembly of claim 15 further comprising a plurality of frame movement means for reducing the coefficient of friction between the assembly and the support surface, and motive means for imparting movement of the assembly relative to the support surface.

17. The translating assembly of claim 16 wherein the frame movement means comprises a plurality of wheels and the motive means comprises at least one motor operatively linked to at least one wheel for imparting rotation thereof.

18. The translating assembly of claim 15 further comprising a second translating assembly removably linked to the first translating assembly wherein the cylinder axis of the first assembly is coaxial with the cylinder axis of the second assembly.

19. The translating assembly of claim 15 further comprising a riding surface having a plurality of substantially planar members wherein each member, excepting perimeter planar members of the riding surface, is flexibly linked to at least two other planar members to create a flexible surface in at least one degree of rotation, and the riding surface has an exposed side and an under side, which contacts the gliding surfaces and exposed portions of the cylinder.

20. The translating assembly of claim 18 further comprising a riding surface having a plurality of substantially planar members wherein each member, excepting perimeter planar members of the riding surface, is flexibly linked to at least two other planar members to create a flexible surface in at least one degree of rotation, and the riding surface has an exposed side and an under side, which contacts the gliding surfaces and exposed portions of the cylinder.

* * * * *